United States Patent [19]

Soininen

[11] Patent Number: 4,823,477

[45] Date of Patent: Apr. 25, 1989

[54] METHOD AND APPARATUS FOR THE LEVELLING OF THE HUMIDITY PROFILE OF A CONTINUOUS WEB BY DIELECTRIC DRYING

[75] Inventor: Mauri Soininen, Naantali, Finland

[73] Assignee: Imatran Voima Oy, Helsinki, Finland

[21] Appl. No.: 133,127

[22] PCT Filed: Dec. 12, 1986

[86] PCT No.: PCT/FI86/00148

§ 371 Date: Aug. 12, 1987

§ 102(e) Date: Aug. 12, 1987

[87] PCT Pub. No.: WO87/03632

PCT Pub. Date: Jun. 18, 1987

[30] Foreign Application Priority Data

Dec. 12, 1985 [FI] Finland ..... 854916

[51] Int. Cl.[4] ..... B01K 5/00

[52] U.S. Cl. ..... 34/1; 34/7; 34/41

[58] Field of Search ..... 34/1, 17, 7, 4, 39, 34/41

[56] References Cited

U.S. PATENT DOCUMENTS 3,293,765 12/1966 Winkler ..... 34/1

3,470,621 10/1969 Bennett ..... 34/1

*Primary Examiner*—Henry A. Bennet

*Attorney, Agent, or Firm*—Birch, Stewart, Kolasch & Birch

[57] ABSTRACT

A method and an apparatus for reducing moisture differentials of a moving web, for instance, a paper web, containing longitudinal wet streaks, by applying high-frequency electromagnetic energy to bar-formed electrodes, which are located close to the surface of the web. In accordance with the invention, the longitudinal axes of the electrodes are aligned approximately parallel to the machine direction of the web and the electrodes are located over each wet streak of the web. The apparatus in accordance with the invention comprises a beam extending in the cross direction essentially over the web, with each electrode fitted to the beam so as to align the longitudinal axis of the electrode in the home position approximately parallel to the machine direction of the web and provided with a means of transferring each electrode in the aforementioned cross direction onto an assigned wet streak in the web. The invention provides an economical and effective solution for reducing moisture differentials in the web.

14 Claims, 1 Drawing Sheet

METHOD AND APPARATUS FOR THE LEVELLING OF THE HUMIDITY PROFILE OF A CONTINUOUS WEB BY DIELECTRIC DRYING

The present invention relates to a method for the improvement of the moisture profile of a continuous web by means of dielectric drying.

The present invention also involves an apparatus for the implementation of the method.

The product quality of several continuous web processing machines including, for instance, paper and textile web drying sections, is impaired by the uneven final moisture profile present in the web.

The problem is most recognized and quantitatively most important in the paper industry. Users require a product with an even final moisture content in order to ensure non-problematic runnability in printing, as well as to achieve a high dimensional stability of the web for accurate alignment of colors.

The unevenness of web moisture is caused by different defective functions at the wet end either before the drying section or in the dryer itself. The web defects may be generated by incorrect crowning of the press rolls, unevenness of the pressing felts or their cleaning, or by temperature differentials of the web. Persistent or random defects on the final humidity profile of the web on the dryer are caused by the edge effect related to the low humidity of the drying atmosphere and higher heat transfer factors at the edge of the web, as well as by the surface of the drying cylinder extending over the web edge, the nonsymmetrical air circulation, uneven action of the drying felts together with, for instance, the defects of condensate removal from the cylinders and asymmetrical flow of the condensate.

In order to compensate for these defects, several different auxiliary apparatus have been developed. Their operation is based on the principle of intentionally providing a functional defect which compensates for a defect of the machine, often originating from an unrecognized cause.

Rather typical examples of these means are different kinds of air blowing units, in which the atmosphere in the drying pockets is sectionally adjusted in a compensatory manner. The effect of one air blowing unit is minimal and, consequently, several units are needed for each machine; generally, as many as possible without the space limitations.

When high-velocity hoods are used, relatively few will suffice because the method of blowing air via nozzles on the paper achieves high characteristic evaporation rates and differential rates. Due to their clumsiness and high power consumption, these solutions are not very popular.

In contrast, infrared radiant heaters heated by gas or electricity with a sectionally controlled effect are very effective and popular.

In some cases, a high-frequency electromagnetic field has been used for profile improvement by locating bar electrodes cross-directionally to the web over a sufficiently large area. The dielectric constant and loss factor that determine the power absorbed as heat by the web are higher at the wetter parts of the web. Consequently, a dielectric dryer drives moisture more effectively out from the wetter parts of the web than from the dry parts when the unit is located at the dry end of the drying section. However, the disadvantage of crosswise located bar electrodes is an increase in power consumption of the dryer due to the unnecessary simultaneous drying of the dry streaks. This leads to the fact that the dryer cannot produce an even final moisture but only reduces the highest absolute and relative humidity differentials. In order to achieve any effective differential drying at all, this kind of moisture profile correcting dryer must be located at the relatively dry section of the web with a correspondingly low dielectric constant and loss factor. Naturally, this is disadvantageous with consideration to the size of the drying section. Compared to the other methods described above, however, this solution provides the advantage of disposing of any control means in the crosswise direction of the web.

The present invention relates to a method for reducing differentials of moisture profile in a web, especially a paper web, by means of high-frequency electromagnetic energy.

The present invention is characterized by the use of bar electrodes, energized by a high-frequency electromagnetic power source and aligned approximately in the machine direction, for drying the web.

More specifically, the method and apparatus in accordance with the present invention is characterized by what is stated within the meets and bounds of the claims.

Furthermore, the apparatus in accordance with the invention is characterized by what is stated in the characterizing part of claim 7.

The present invention will now be described in more detail with reference to exemplifying the embodiments described in the attached figures. For the sake of presentation simplicity and clarity, the figures omit all elements unessential to the present invention, such as components associated with the generation and feed of the electromagnetic energy; equipment necessary for environmental protection from radiated energy, possible automatic control devices, actuators and their details required for movement, ventilation equipment necessary for humidity removal and advancement of drying, and the like.

BRIEF DESCRIPTION OF THE DRAWINGS

The present invention will become more fully understood from the detailed description given here and below and the accompanying drawings which are given by way of illustration only, and thus, are not limitative of the present invention, and wherein:

The processing of a wet streak in the machine direction of the web requires a drying unit consisting of at least two electrodes 2, which are located parallel to the processed web 1, and approximately aligned in the machine direction of the web (arrow A). FIGS. 1 and 2 show the mounting of the electrodes in a carriage 4, which can move along a beam 3 by automatic, remote-controlled or manually controlled means with the help of the apparatus not described in the figures, to a selected wet streak in the web. These kind of units can be located lengthwise to the beam 3, that is, in the cross direction of the web in a number corresponding to the number of the wet streaks.

Figure 1:
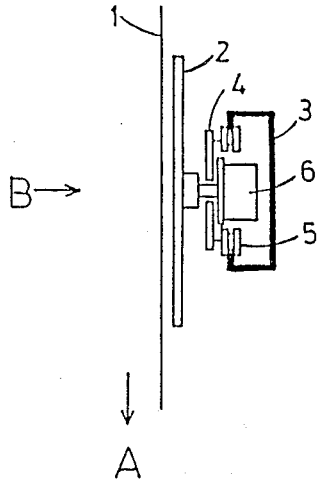
FIG. 1 shows an apparatus in accordance with the invention in a side elevation view aligned in a plane present with a web being processed.
Figure 2:
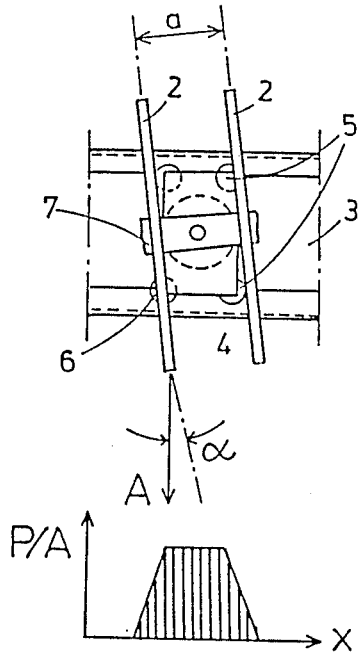
FIG. 2 shows the the apparatus of FIG. 1, viewed from the direction of arrow B in FIG. 1.

When a mounting base 7 of the electrodes is mounted pivotable with an actuator 6 around a pin, an angle L can be provided between the direction of the electrodes and the machine direction of the web. In addition, the mounting base 7 can be complemented with required fixtures and possible actuators that are not shown in the figures, and with which a mutual distance a of the electrodes can be adjusted automatically, by remote-control or manually in accordance with the correction requirements of the web moisture. Thus by varying the orientation of the electrodes, a local energy density P/A imposed on the web can be provided in the direction of the crosswise coordinate x of the web yielding an energy distribution that conforms as accurately as possible with the moisture distribution of the wet streak to be corrected. The lower part of FIG. 2 shows the variable P/A as a function of coordinate x for the electrode orientation shown in FIG. 2.

The present invention offers appreciable benefits.

The power consumption required is decreased and the equipment necessary for generating the high-frequency energy may be smaller. This is produced by the disposal of unnecessary drying which avoids the consumption of power for processing intermediate areas between the wet streaks, which also reduces power consumption at the wet streaks because less evaporation is required for correcting the moisture profile.

In principle, an evenly distributed moisture content can be achieved. This is not possible with crosswise electrodes extending over the entire web, whose selective drying effect for drying a wet part of the web faster than a dryer part of the web is based on the differentials of the electrical characteristics of the dried substance at different moisture levels. For this reason, although the crosswise electrodes are capable of reducing the moisture differential, they are not capable of fully levelling them off.

In addition to achieving a reduced number of electrodes by eliminating the electrodes at the dry parts of the web, a reduction in electrode numbers is also achieved by advantageously locating the moisture profile correction units over the wet streaks at the wet end of the machine where the dielectric constant of the web is most suitable for the method.

The described moisture profile correction units are located in a paper machine for drying the web at the web transfer when the web is conveyed from one drying cylinder to another. The suggested location is especially advantageous in modern high-speed machines that tend to employ, as a design of the art, the single wire transfer at the wet end of the machine immediately after the press section. This means that the web is conveyed, supported by the drying wire, from one cylinder to another, a method which reduces the frequency of paper breaks in a high-speed drying section. The disadvantage of the method is that on every other cylinder, generally on the lower cylinders, the drying wire passes between the paper web and the cylinder.

Figure 3:
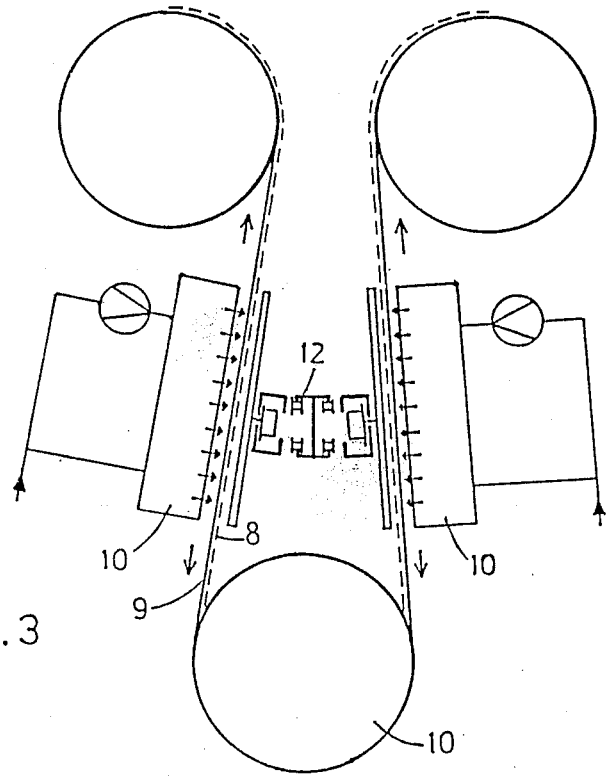
FIG. 3 shows a preferred location for the apparatus, especially in a high-speed paper web drying section.

A special advantage in paper machines is achieved by locating a moisture profile correction unit 12 in a single wire group as shown in FIG. 3. When the correction unit 12 is located on the side of a web 9 supported by wire 8, the ventilation equipment 10, e.g. nozzle blowing equipment for drying and profile correction, can be located on the paper side and adapted to blow immediately against the paper. This provides an especially safe arrangement against breaks and an effective location for drying. In addition, FIG. 3 shows that the cylinder is preferably positioned lower than normal for easier location and higher efficiency of the correction unit, which also lengthens the free passages of web transfer.

What is claimed is:

1. A method for reducing moisture differentials in a moving web containing wet streaks extending in the processing direction of the web, by the application of high-frequency electromagnetic energy fed to bar-formed electrodes which are located close to the surface of the web, wherein the longitudinal axes of the electrodes are aligned approximately parallel to the Processing direction of the web and the electrodes can be moved transverse to the processing direction of the web and rotated at an angle relative to the processing direction of the web so as to be positioned only over each wet streak of the web in order to provide a uniform moisture profile in the web.

2. The method in accordance with claim 1, wherein each electrode is attached by a support base to a beam extending over the web.

3. The method in accordance with claim 1 wherein the location of the electrodes in a plane parallel with the web and their angle in relation to the processing direction of the web are adjusted wither manually or automatically so as to selectively apply, as accurately as possible, to each streak a proportional drying power in order to minimize the moisture differential in the web.

4. The method in accordance with claim 1 wherein the web is processed on rotating cylinders and a drying unit assembly consisting of the electrode, a support base and a beam are fitted into a contact dryer section on the web disposed between two successive cylinders.

5. The method in accordance with claim 4 wherein the drying unit assembly is fitted into a single-wire section of the web contact dryer on the web and a supporting wire passes from one cylinder to another to support the web so that the wire remains between the web and the electrodes of the drying unit assembly.

6. The method in accordance with claim 4, wherein an air blowing dryer is disposed on the opposite side of the web from the electrodes of the drying unit and blows air toward said drying unit.

7. The method of claim 1 wherein the web is a paper web or a textile web.

8. The apparatus of claim 7 wherein the processing length of the web is lengthened by increasing the mutual center point distances of successive roller means.

9. An apparatus for reducing moisture differentials in a moving web containing wet streaks therein which comprises means for conveying the web of material, bar-formed electrodes operatively associated with the surface of the moving web for applying high-frequency electromagnetic energy thereto, wherein the longitudinal axes of the electrodes are aligned substantially parallel to the processing direction of the moving web, means for moving the electrodes transverse to the processing direction of the web and means for rotating the electrodes at an angle relative to the processing direction of the web, whereby the electrodes can be selectively positioned over each of the wet streaks in the web in order to provide a substantially uniform moisture profile in the web.

10. The apparatus of claim 9 wherein the bar electrodes are at least two in number.

11. The apparatus of claim 9 wherein the bar electrodes are mounted in a beam which extends across the width of the web.

12. The apparatus of claim 9 where the means for conveying the web are roller means and the bar-formed electrodes are disposed between adjacent roller means.

13. The apparatus of claim 12 wherein the web is supported by wire means as it is conveyed between roller means, said wire means being disposed between the web and the bar-formed electrodes.

14. The apparatus of claim 13 wherein an air-blowing dryer is operatively associated with the moving web on opposite sides of said web from bar-formed electrodes.

* * * * *